US008344275B2

(12) United States Patent
Ariyoshi et al.

(10) Patent No.: US 8,344,275 B2
(45) Date of Patent: Jan. 1, 2013

(54) SWITCHING DEVICE

(75) Inventors: Yuji Ariyoshi, Osaka (JP); Muneyoshi Miyata, Tokyo (JP); Shinichi Tadano, Tokyo (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/213,750

(22) Filed: Aug. 19, 2011

(65) Prior Publication Data

US 2012/0048705 A1 Mar. 1, 2012

(30) Foreign Application Priority Data

Aug. 30, 2010 (JP) ..... 2010-192201
Oct. 19, 2010 (JP) ..... 2010-234663
Jul. 5, 2011 (JP) ..... 2011-149250

(51) Int. Cl.
*H01H 3/04* (2006.01)

(52) U.S. Cl. ..... 200/51 R

(58) Field of Classification Search ..... 200/51.11, 200/51.12, 51 R, 553, 558, 559, 561, 562, 200/563, 284
See application file for complete search history.

(56) References Cited

U.S. PATENT DOCUMENTS

2007/0099483 A1* 5/2007 Tsai ..... 439/492
2009/0104821 A1* 4/2009 Marti et al. ..... 439/676
2011/0063741 A1* 3/2011 Park et al. ..... 359/823

* cited by examiner

*Primary Examiner* — Gary F. Paumen

(74) *Attorney, Agent, or Firm* — Norris McLaughlin & Marcus P.A.

(57) ABSTRACT

In a switching device 1 formed by integrating a connector 4 for coupling a flexible printed wiring board to a lever switch 2, the lever switch 2 comprises: a case 3; a fixed contact 20 and a movable contact 30 installed inside the case 3; and a lever 40 that deforms the movable contact 30 by tilt operation to switch contact with the fixed contact 20, the connector 4 covers a connecting terminal of the fixed contact 20 protruding from the case 3, and includes a connector cover 60 in which an insertion opening 62 to insert the flexible printed wiring board 100, and the terminal 101 of the board 100 is connected to the connecting terminal of the fixed contact 20 when the board 100 is inserted in the insertion opening 62.

10 Claims, 15 Drawing Sheets

(a)

(b)

(a)

(b)

(a)

(b)

SWITCHING DEVICE

BACKGROUND OF THE INVENTION

1. Field of the Invention

The present invention relates to a switching device formed by integrating a connector for a flexible printed wiring board into a lever switch, to a switching device in which a coupling terminal portion for a flexible printed wiring board, etc., are provided at a lever switch, and to an electronic device including either of these switching devices.

2. Description of the Related Art

For example, in a disc player, such as a CD (Compact Disc), a DVD (Digital Versatile Disc), or a BD (Blu-ray Disc), a control circuit board is incorporated inside a device. Mounted on this circuit board are various types of parts, such as a motor for opening and closing a disc tray, and a lever switch that detects the opening and closing, as described in the Japanese Patent Laid-Open No. 2008-277304.

Conventionally, assembling work of these parts is performed as follows. One end of a flexible printed wiring board (FPC, hereinafter referred to as a "flexible board") is coupled to a connector provided on a circuit board to thereby electrically connect the circuit board and the flexible board, and a lever switch is implemented on the circuit board to perform work for electrically connect the circuit board and the lever switch, whereby the lever switch and the flexible board are indirectly wired through the circuit board. In addition, aside from this, such work is also required that a terminal for electronic part, such as a motor, is provided on the circuit board, and that this terminal for electronic part and the part such as the motor are connected to each other.

As described above, in the conventional parts assembling work in an electronic device, such as a disc player, there has been a problem of causing the increase in manufacturing cost of the whole device due to a numbers of work processes and complicated work content.

SUMMARY OF INVENTION

The present invention is made to solve such problem, and an object of the present invention is to provide a switching device that can achieve reduction of the number of work processes and improvement in work efficiency when assembled to a circuit board inside a device, such as a disc player, and that can reduce manufacturing cost of the whole device, and to provide an electronic device including any of these switching devices.

In order to achieve the above-described object, a first present invention is a switching device formed by integrating a connector for a flexible printed wiring board into a lever switch, wherein the lever switch comprises a fixed contact and a movable contact that are installed inside a case, and a lever that deforms the movable contact by tilt operation to switch contact with the fixed contact, the lever being supported by the case, and wherein the connector covers a connecting terminal of the fixed contact protruding from the case, and includes a connector cover in which an insertion opening to insert the flexible printed wiring board is provided, and wherein when the flexible printed wiring board is inserted in the insertion opening, a terminal of the board is connected to the connecting terminal of the fixed contact.

A second present invention is a switching device formed by integrating a connector for a flexible printed wiring board into a lever switch, wherein the lever switch comprises a terminal for electronic part, a fixed contact, and a movable contact that are installed in a case, and a lever that deforms the movable contact by tilt operation to switch contact with the fixed contact, the lever being supported by the case, and wherein the connector covers one end of the terminal for electronic part protruding from the case and a connecting terminal of the fixed contact protruding from the case, and includes a connector cover in which an insertion opening to insert the flexible printed wiring board is provided, and wherein when the flexible printed wiring board is inserted in the insertion opening, a terminal of the board is connected to the terminal for electronic part and to the connecting terminal of the fixed contact.

In the second present invention, the terminal for electronic part can be used as a motor terminal.

In the second present invention, as a coupling structure of the case and the connector cover, can be employed a structure in which a locking claw is provided at a tip of a flange extended on a side surface of the case, and in which when the connector cover is applied to the flange, the locking claw fits in a locking hole of the connector cover.

In the second present invention, a spring-like contact portion whose tip is curved may be provided at the terminal for electronic part protruding from the case, or at the connecting terminal of the fixed contact.

A third present invention is a switching device in which a coupling terminal portion for a flexible printed wiring board is provided at a lever switch, wherein the lever switch comprises a fixed contact and a movable contact that are installed in a case, and a lever that deforms the movable contact by tilt operation to switch contact with the fixed contact, the lever being supported by the case, and wherein the coupling terminal portion is comprised of a connecting terminal of the fixed contact protruding from the case, and wherein a terminal of the flexible printed wiring board is connected to the coupling terminal portion.

In the third present invention, the lever switch may be configured such that it has a terminal for electronic part for external input other than the fixed contact, and that one end of the terminal for electronic part for external input is arranged side by side with the coupling terminal portion, and that each of the terminals of the flexible printed wiring board is connected to the coupling terminal portion and the one end of the terminal for electronic part for external input.

<<Definition 1>> In the third present invention, the "coupling terminal portion" that constitutes this invention includes as a narrower concept of the invention the "connector", which is a configuration requirement of the first invention, and an other connector with a different configuration from this "connector".

<<Definition 2>> The requirement in this third present invention, "the terminal of the flexible printed wiring board is connected to the coupling terminal portion", includes both a case where the terminal of the flexible printed wiring board and the coupling terminal portion are directly electrically connected to each other using a conductive agent, such as solder, and a case where the terminal of the flexible printed wiring board and the coupling terminal portion are directly electrically connected to each other using the connector.

An electronic device concerning the present invention includes either of the switching devices concerning the first to the third present inventions. As this kind of electronic device, there shall be included a disc player, such as a CD, a DVD, or a BD, a disc recorder, and other electronic devices.

According to the switching devices concerning the first and the second present inventions, since the connector for the flexible printed wiring board is integrated into the lever switch, this switching device is mounted on a circuit board inside a device, such as a disc player, and the flexible printed wiring board is inserted in the connector of the mounted switching device, only thereby enabling to wire with the lever switch without interposing the circuit board. Hence, since the number of work processes is reduced, and work efficiency is also improved significantly compared with the conventionally performed assembling work, manufacturing cost of the whole device can be reduced.

In addition, according to the switching device concerning the third present invention, since the coupling terminal portion for the flexible printed wiring board is provided at the lever switch, this switching device is mounted on the circuit board inside the device, such as the disc player, and the terminal of the flexible printed wiring board is connected to the coupling terminal portion of the mounted switching device, only thereby enabling to wire the lever switch and the flexible printed wiring board without interposing the circuit board. Hence, since the number of work processes is reduced, and work efficiency is also improved significantly compared with the conventionally performed assembling work, manufacturing cost of the whole device can be reduced.

BRIEF DESCRIPTION OF DRAWINGS

FIG. 1A is an external view, and FIG. 1B is a cross-sectional view.

FIG. 3A is a plan view, FIG. 3B a left side view, FIG. 3C a right side view, and FIG. 3D a cross-sectional view taken along a line A-A.

FIG. 4A is a plan view, FIG. 4B an elevational view, and FIG. 4C a bottom view.

FIG. 5A is a left-side view, FIG. 5B an elevational view, FIG. 5C a right-side view and FIG. 5D a bottom view.

FIG. 6A is a plan view, FIG. 6B a left side view, FIG. 6C a right side view, and FIG. 6D a cross-sectional view taken along a line B-B.

FIG. 7A is a left side view, FIG. 7B a plan view, FIG. 7C a right side view, and FIG. 7D a cross-sectional view taken along a line C-C.

FIG. 9A is an external view, and FIG. 9B is a cross-sectional view.

FIG. 10A is a plan view, FIG. 10B a left side view, FIG. 10C a right side view, and FIG. 10D a cross-sectional view taken along a line D-D.

FIG. 11A is an external view, and FIG. 11B is a cross-sectional view.

FIG. 13A is a plan view, FIG. 13B a left side view, FIG. 13C a right side view, and FIG. 13D a cross-sectional view taken along a line A-A.

FIG. 14A is a plan view, FIG. 14B an elevational view, and FIG. 14C a bottom view.

FIG. 15A is a left-side view, FIG. 15B an elevational view, FIG. C a right-side view and FIG. 15D a bottom view.

FIG. 16A is a plan view, FIG. 16B a left side view, FIG. 16C a right side view, and FIG. 16D a cross-sectional view taken along a line B-B.

DETAILED DESCRIPTION OF THE PREFERRED EMBODIMENTS

Hereinafter, embodiments of the present invention will be described with reference to drawings attached to an application.

Embodiment of the First Present Invention

Figure 1:
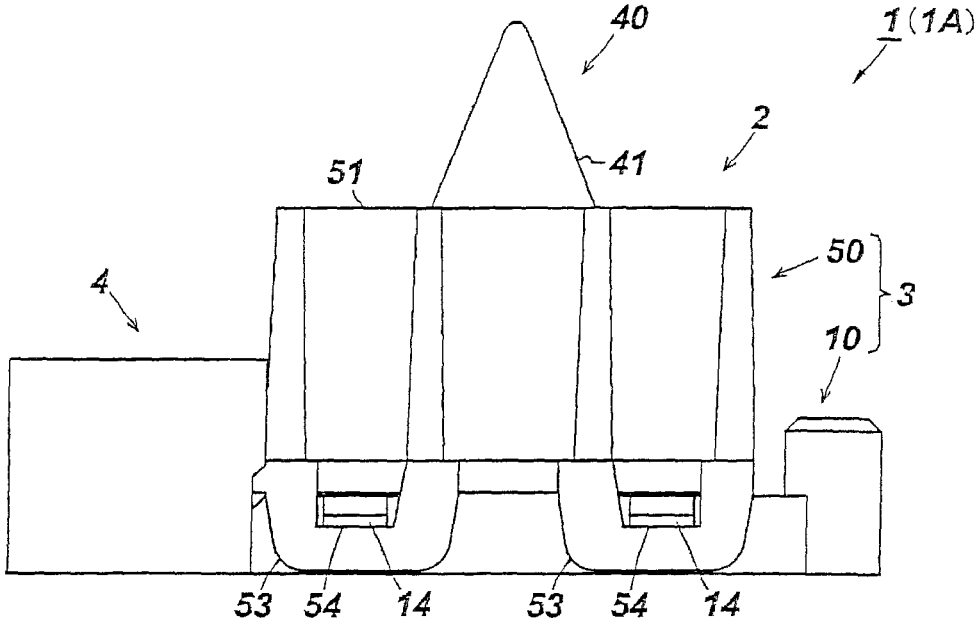
FIGS. 1A and 1B are views showing an embodiment of a switching device to which the first present invention is applied.
Figure 1:
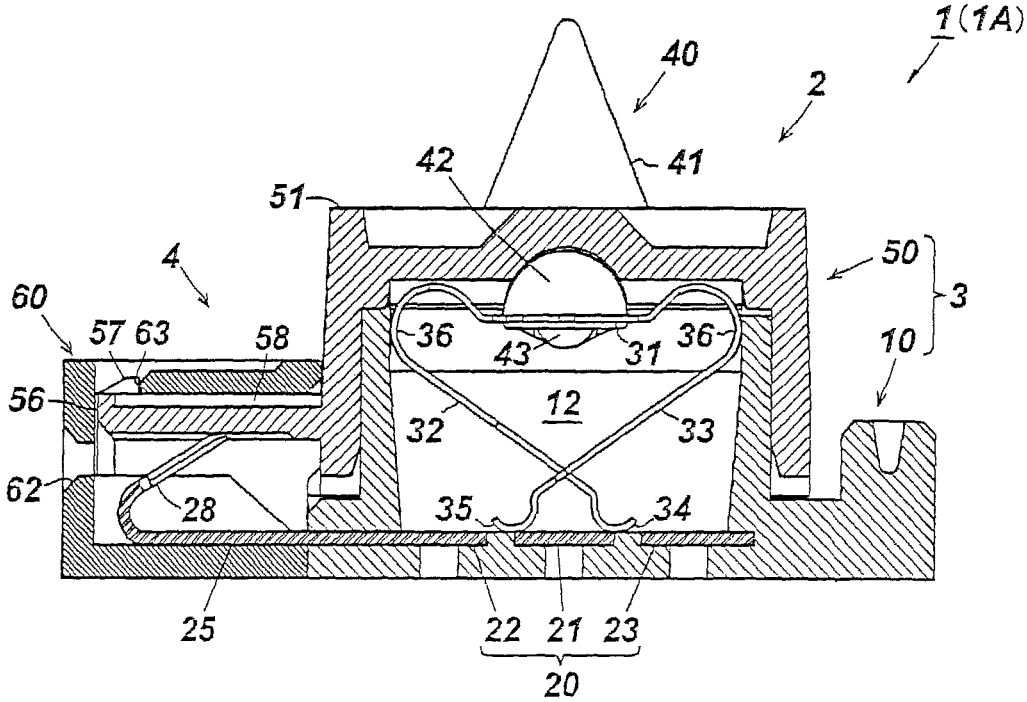
Figure 2:
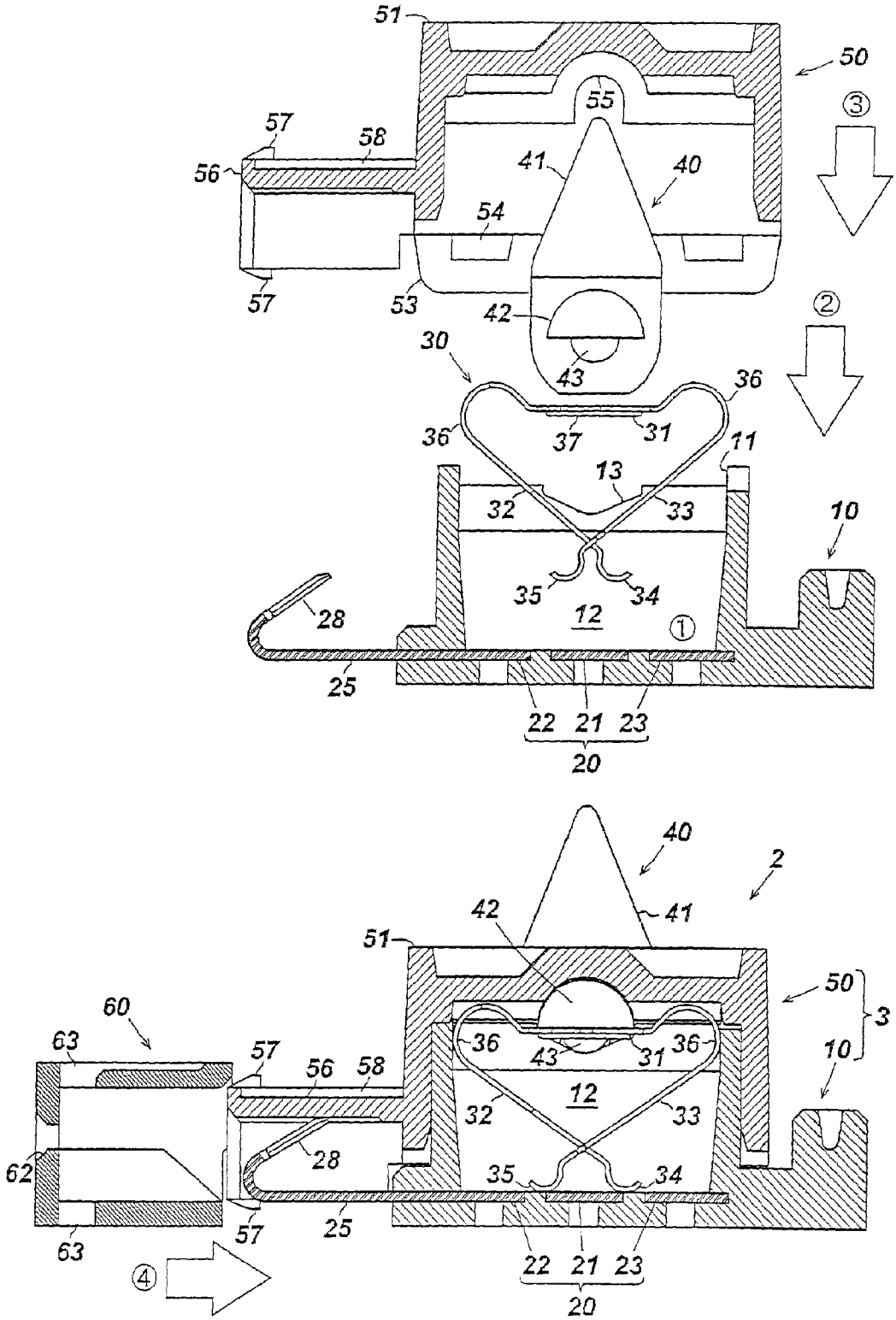
FIG. 2 is an assembly explanatory view of the switching device of FIGS. 1A and 1B.
Figure 3:
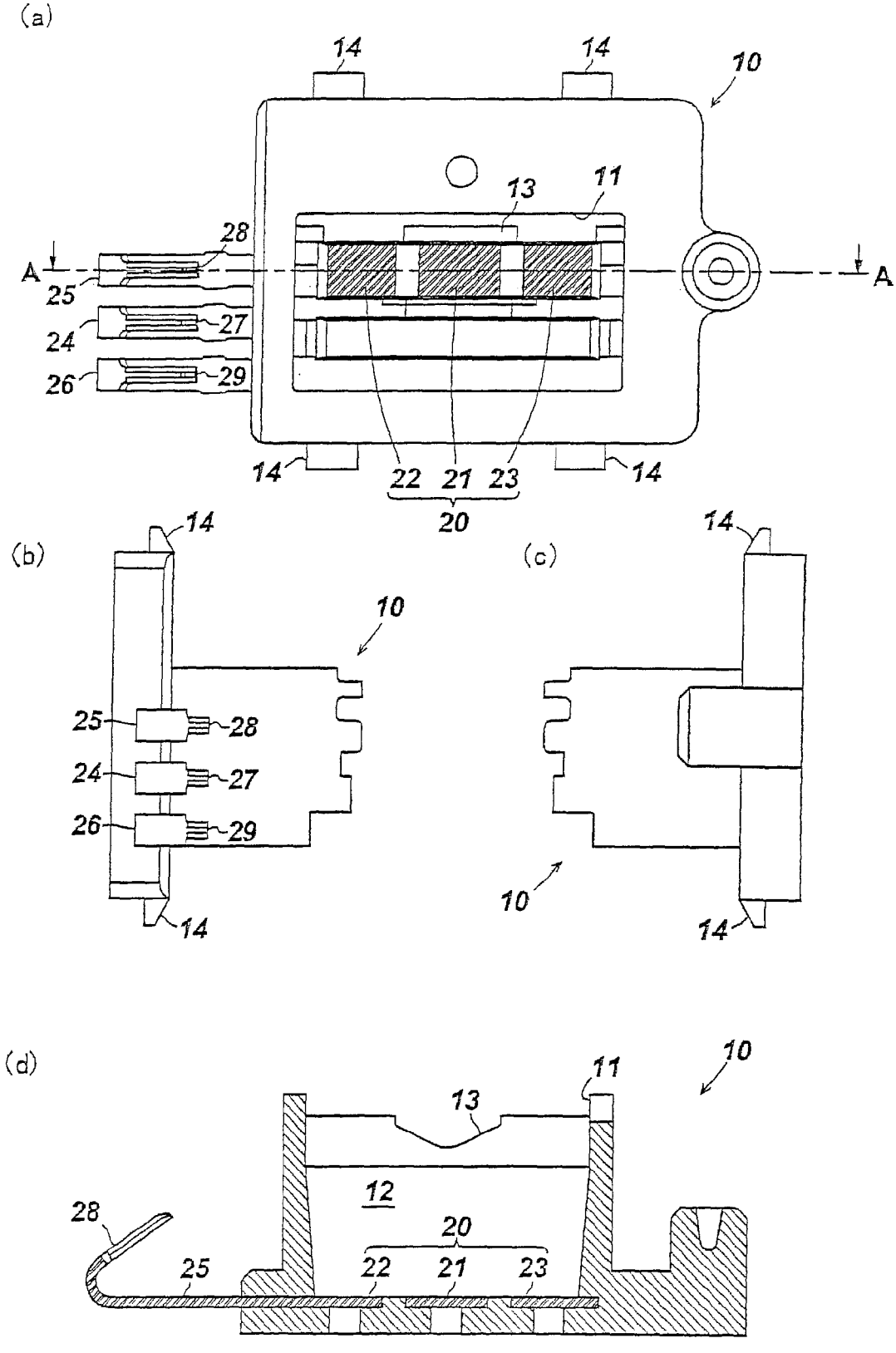
FIGS. 3A to 3D are explanatory views of a base and a fixed contact of FIGS. 1A and 1B.
Figure 4:
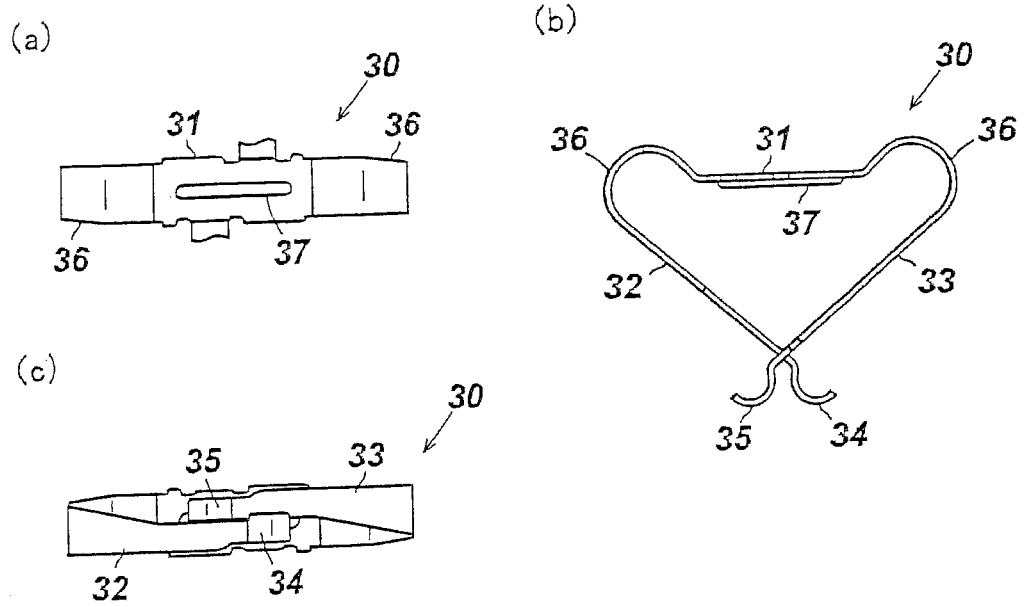
FIGS. 4A to 4C are explanatory views of a contact spring piece of FIGS. 1A and 1B.
Figure 5:
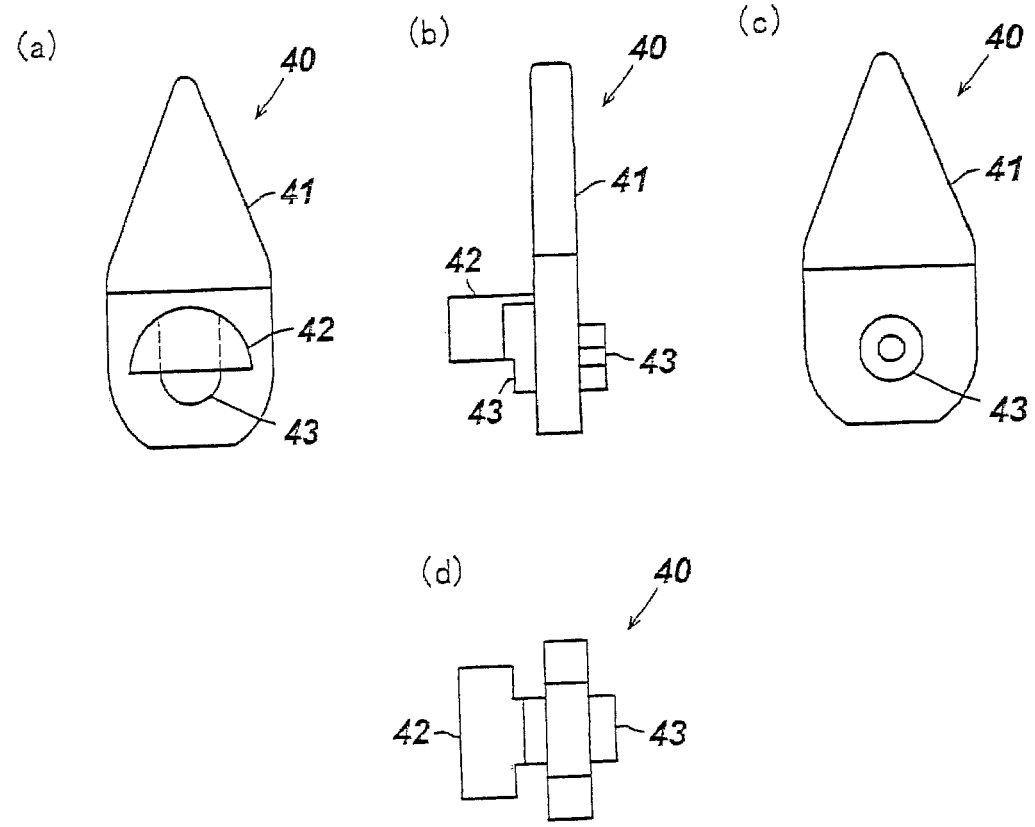
FIGS. 5A to 5D are explanatory views of a lever of FIGS. 1A and 1B.
Figure 6:
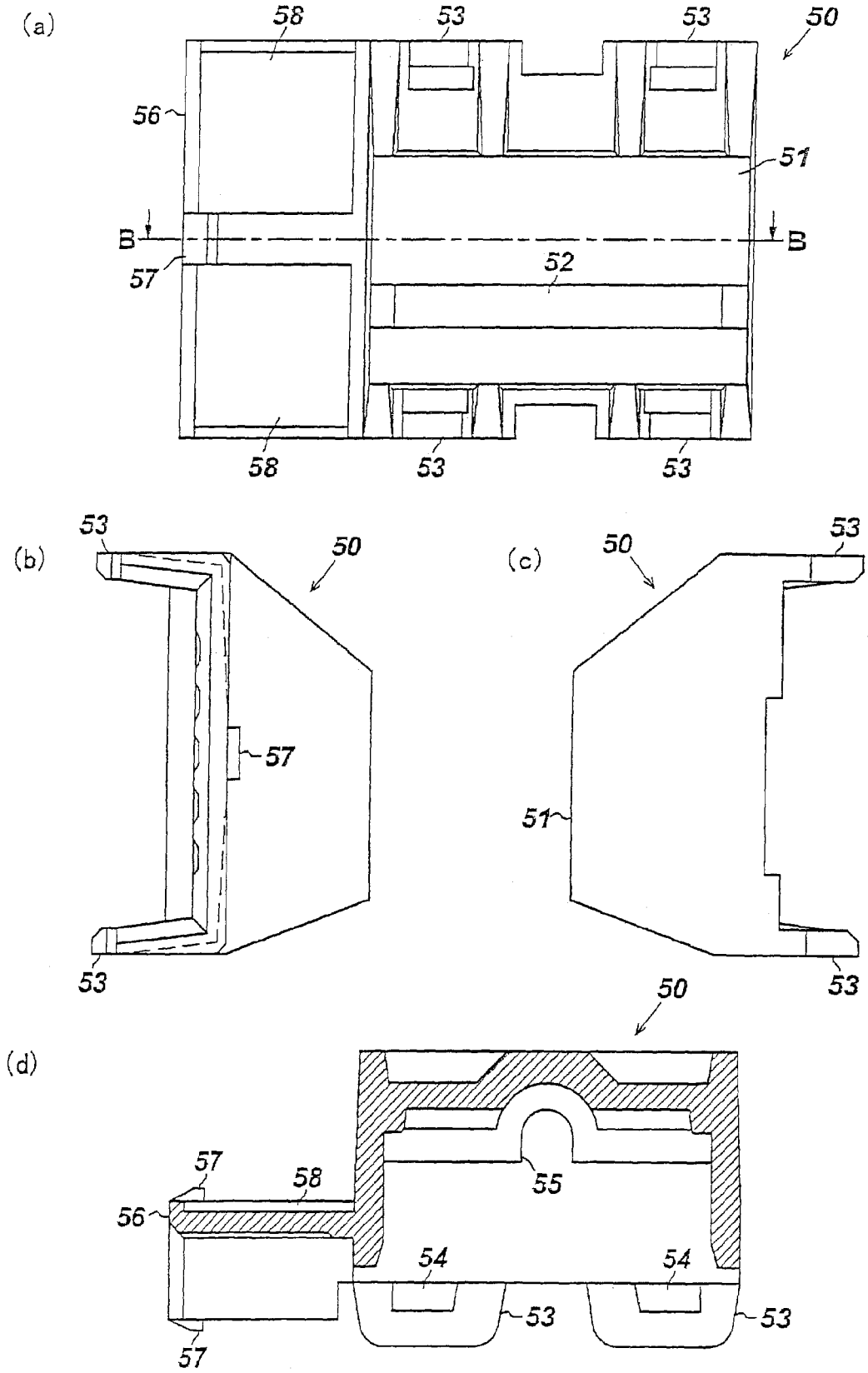
FIGS. 6A to 6D are explanatory views of a top case of FIGS. 1A and 1B.
Figure 7:
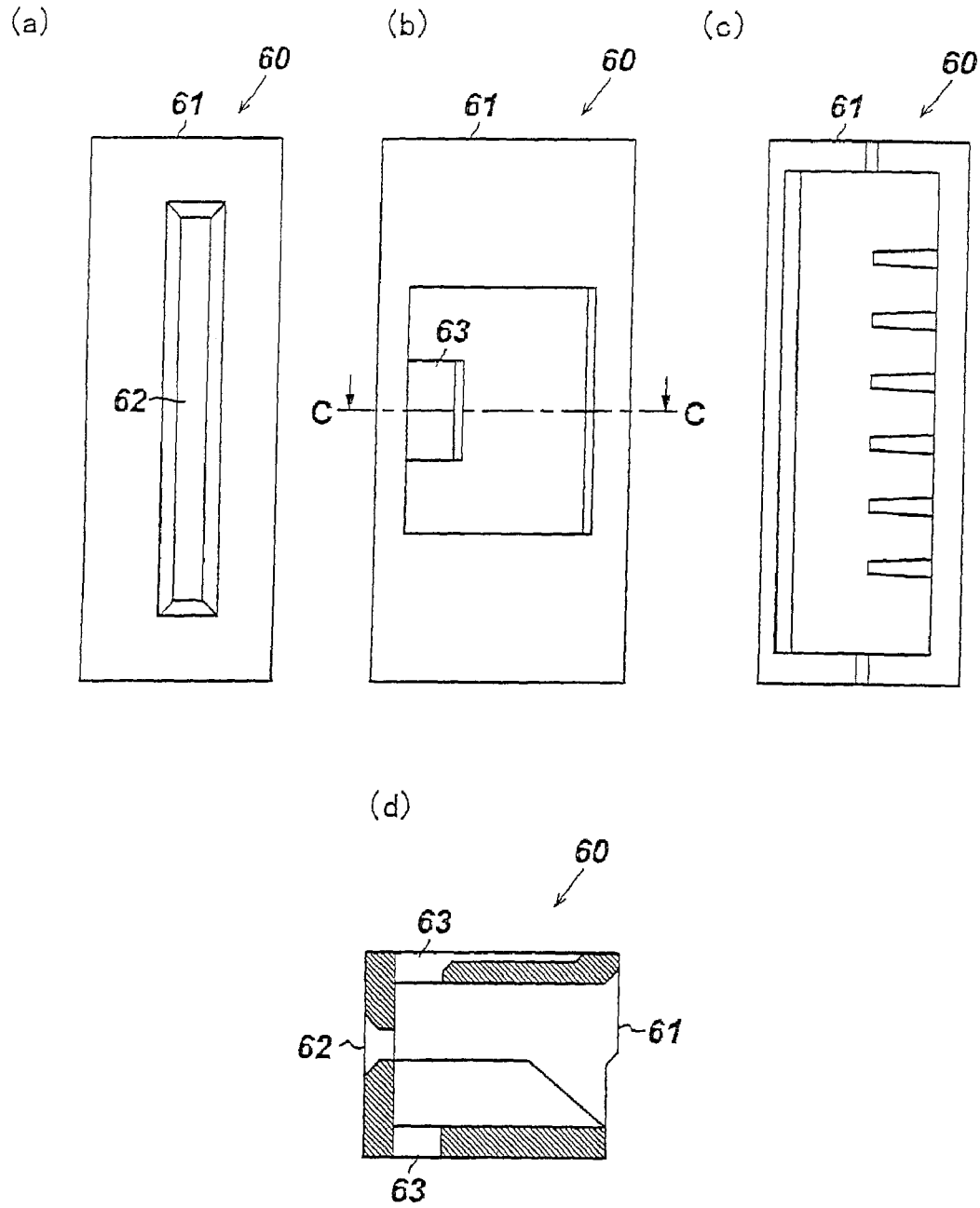
FIGS. 7A to 7D are explanatory views of a connector cover of FIGS. 1A and 1B.
Figure 8:
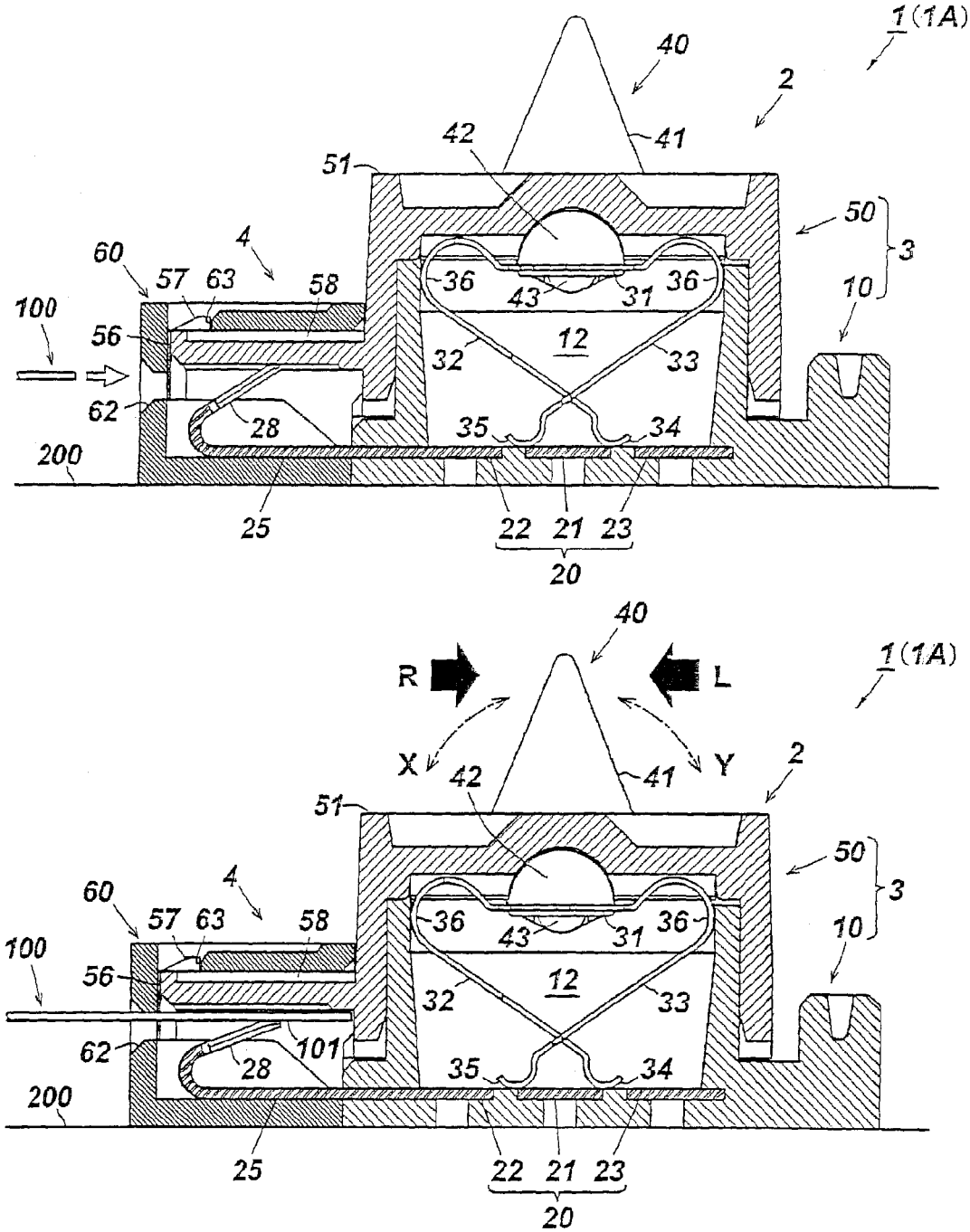
FIG. 8 is a usage explanatory view of the switching device of FIGS. 1A and 1B.

FIGS. 1A and 1B are overall views showing an embodiment of a switching device to which the first present invention is applied, FIG. 2 is an assembly explanatory view of the same switching device, FIGS. 3 to 7 are parts views that constitute the same switching device, and FIG. 8 is a usage explanatory view of the same switching device.

A switching device 1 (1A) shown in FIGS. 1A and 1B is used for detecting opening and closing of a disc tray located inside a device in a disc player, such as a CD, a DVD, or a BD, and it includes a lever switch 2 that is subjected to an external force from opposite two directions to thereby equally operate in the respective directions. In addition, in this switching device 1A, a connector 4 that couples a flexible printed wiring board (abbreviated as the "flexible board" in the following description of the embodiment) inside the device is integrated into a switch housed in a case 3.

As shown in FIG. 2, this switching device 1A comprises each part of a base 10, a fixed contact 20, a movable contact 30, a lever 40, a top case 50, and a connector cover 60, and the parts are assembled in accordance with next processes 1 to 4. Hereinafter, a detailed structure of the each part will be described in the process order.

(1) Process 1: Install the fixed contact 20 on the base 10.

In FIGS. 3A to 3D, the base 10 is formed of a resin material with an insulating property, and has a box having an opening 11 provided in a top surface thereof, and a housing 12 to house parts is provided inside the base 10. On a front surface and a back surface of the base 10, a pair of concave portions 13 and 13 for supporting the lever 40 are formed, and hooks 14, 14, and . . . for applying the top case 50 are provided.

The fixed contact 20 is formed by punching a metal plate with conductivity in a predetermined pattern, and it is comprised of a central common contact portion 21 and two individual contact portions 22 and 23 spaced apart at both sides thereof. These common contact portion 21 and individual contact portions 22 and 23 are inserted on a bottom surface in the housing 12 at the time of forming the base 10, and connecting terminals 24, 25, and 26 connected to these contact portions are provided protruding from a left side surface of the base 10, respectively.

In addition, at the connecting terminals 24, 25, and 26 of the fixed contact 20 protruding from the base 10, provided are spring-like contact portions 27, 28, and 29 whose tips are curved upwardly into U shapes. It is to be noted that as shown in FIGS. 3A to 3D, on the left side surface of the base 10, starting from a back, the connecting terminal 25 of the left individual contact portion 22, the connecting terminal 24 of the common contact portion 21, and the connecting terminal 26 of the right individual contact portion 23 are arranged side by side at regular intervals.

(2) Process 2: Set the movable contact 30 and the lever 40 to the base 10.

As shown in FIGS. 4A to 4C, the movable contact 30 is comprised of a contact spring piece formed by bending a metal flat spring material to a predetermined shape. When this contact spring piece is viewed from the front, it is a shape of an inverted triangle, and it includes a pair of spring portions 32 and 33, which are formed by directing a base of the inverted triangle upwardly to be horizontal as a base portion 31, and by crossing the remaining two sides of the inverted triangle at a lower side.

The pair of spring portions 32 and 33 is set to have the same length, a first contact portion 34 is provided at a tip of one spring portion 32, and a second contact portion 35 is provided at a tip of the other spring portion 33. These first contact portion 34 and second contact portion 35 are respectively curved in order to make them slide easily on the fixed contact 3. It is to be noted that a proper elastic force is given to the movable contact 30 by half-bent portions 36 formed by bending both ends of the base portion 31 into U shapes, and that durability is improved by a reinforcing rib 37 formed by making a center of the base portion 31 bulge downwardly.

As for setting work of the movable contact 30, as shown in FIG. 2, it is only necessary to insert the movable contact 30 from the opening 11 of the base 10, and then to place it on the bottom surface in the housing 12. As a result of this, the movable contact 30 rises due to the pair of spring portions 32 and 33, and both the first contact portion 34 and the second contact portion 35 get contact with the common contact portion 21 arranged in the center.

As shown in FIGS. 5A to 5D, the lever 40 is formed of a resin material with an insulating property, and it is comprised of an operating portion 41, a cam portion 42, and a shaft portion 43. The operating portion 41 is formed to be a thin plate, and the cam portion 42 cut out to be a semicircular shape is provided on a surface of the operating portion 41, and additionally, the pair of shaft portions 43 and 43 is protrudingly provided on both front and back surfaces of the operating portion 41.

The lever 40 is also set to the base 10, and the setting work is performed such that as shown in FIG. 2, the lever 40 is inserted from the opening 11 of the base 10, and that the shaft portion 43 is inserted in the concave portion 13 of the base 10 to thereby support both ends of the shaft portion 43 at a center of the concave portion 13. As a result of this, the lever 40 is rotatably supported on a bearing with the shaft portion 43 being as a support point. In addition, a bottom surface of the cam portion 42 is placed on the base portion 31 of the movable contact 30, and thereby the lever 40 is always in a state of being biased upwardly by the elastic force of the spring portions 32 and 33.

(3) Process 3: Apply the top case 50 to the base 10.

In FIGS. 6A to 6D, the top case 50 is formed of a resin material with an insulating property, and it has a top plate 51 that covers the opening 11 of the base 10. On the top plate 51, formed is an elongated slit 52 penetrating from a front surface to a back surface in order to make the operating portion 41 of the lever 40 protrude outside. In addition, at the top case 50, provided is an attaching piece 53 for applying the top case 50 to the base 10, and at this attaching piece 53, formed are attaching holes 54, 54, and . . . that lock the hooks 14, 14, and . . . of the base 10. Further, on an inner side of the attaching piece 53, formed is a concave portion 55 that prevents interference with the shaft portion 43 of the lever 40.

In addition, a flange 56 for applying the connector cover 60 is extended on a left side surface of the top case 50, and a locking claw 57 is provided at a tip of this flange 56. It is to be noted that a strength of the flange 56 is secured by providing the locking claw 57 in the center of the flange 56 to make it thicker, while flexibility is given to the flange 56 by providing hollow portions 58 at both sides of the locking claw 57 to make the flange 56 thinner so that the flange 56 can be bent at the time of applying the connector cover 60.

In order to apply the top case 50 to the base 10, as shown in FIG. 2, the top case 50 is covered on the base 10, and the hooks 14, 14, and . . . are hooked and locked to the four attaching holes 54, 54, and . . . in all. As a result of this, the case 3, which is an integration between the base 10 and the top case 50, is formed, and it serves as the lever switch 2 in which the movable contact 30 and the lever 40 have been housed in the housing 12 thereinside.

When the top case 50 is applied, only the operating portion 41 of the lever 40 protrudes outside the case 3 from the slit 52, and the lever 40 is retained as it is by the shaft portion 43 interposed between the concave portion 55 of the top case 50 and the concave portion 13 of the base 10. In addition, a back surface of the top plate 51 of the top case 50 presses the half-bent portions 36 and 36 of the both sides of the contact spring piece, and thereby uplift of the movable contact 30 is restricted at the time of operation of the lever 40.

(4) Process 4: Apply the connector cover 60 to the case 3.

In FIGS. 7A to 7D, the connector cover 60 is formed of a resin material with an insulating property, and it includes a hollow cover main body 61 that covers the connecting terminals 24, 25, and 26 of the fixed contact 20 protruding from the case 3. An elongated insertion opening 62 is provided at a side surface of the cover main body 61 in order to insert the flexible board. In addition, on a top surface and a bottom surface of the connector cover 60, provided are locking holes 63 and 63 fitted in the locking claws 57 and 57 formed at the flange 56 of the top case 50.

When the connector cover 60 is applied to the case 3, as shown in FIG. 2, the connector cover 60 is slid along the flange 56 of the top case 50 to be fitted in the case 3. At this time, the flange 56 of the top case 50 is pressed by an inner wall surface of the cover main body 61 to bend and deform, and it slides with the tip thereof being tapered. Subsequently, when the tip of the flange 56 bumps against an end surface in the cover main body 61, the flange 56 expands, the locking claws 57 and 57 are fitted in the two locking holes 63 and 63 of upper and lower parts, and the connector cover 60 is fixed to the case 3. As a result of this, the switching device 1A, which is an integration between the case 3 and the connector cover 60, is completed, and the connector 4 for the flexible board is formed with the case 3 and the connector cover 60.

The switching device 1A of the embodiment to which the first present invention is applied is configured as described above, and a manner of use of the switching device 1A will be described hereinafter.

As shown in FIG. 8, when this switching device 1A is used, the case 3 of the switch is fixed to a circuit board 200 incorporated in an electronic device, such as a BD player and a BD recorder, and a flexible board 100 is coupled to the connector 4.

Namely, when one end of the flexible board 100 is inserted in the insertion opening 62 of the connector cover 60, the three U-shaped spring-like contact portions 27, 28, and 29 located inside the connector 4 bend and deform, the end of the flexible board 100 gets contact with the end surface of the case 3, and coupling between the connector 4 and the flexible board 100 is completed. As a result of this, a terminal 101 of the flexible board 100 is connected to the connecting terminals 24, 25, and 26 of the fixed contact 20. It is to be noted that in the embodiment, since respective tips of the connecting terminals 24, 25, and 26 of the fixed contact 20 serve as the U-shaped spring-like contact portions 27, 28, and 29, a predetermined contact pressure can be obtained with respect to the terminal 101 of the flexible board 100, and thus the contacts can be reliably connected to each other.

In addition, in the lever switch 2 constituting the switching device 1A, when an external force acts in a direction shown with an arrow L or R with respect to the operating portion 41 of the lever 40 protruding from the case 3, the lever 40 tilts in each direction with the shaft portion 43 being as the support point to thereby switch contact between the movable contact 30 and the fixed contact 20.

Namely, when a disc tray of the BD player is opened, and a force in the arrow L direction is applied to the lever 40, the operating portion 41 tilts in an arrow X direction, and a corner of the cam portion 42 that has tilted in tandem with this tilt of the operating portion 41 presses a left end of the base portion 31 of the movable contact 30. The movable contact 30 is elastically deformed by this pressing force, and the first contact portion 34 of a tip of the one spring portion slides and moves to a right side, whereby the first contact portion 34 separates from the central common contact portion 21, and gets contact with the right individual contact portion 23. At this time, the second contact portion 35 of a tip of the other spring portion remains in contact with the common contact portion 21. Hence, the common contact portion 21 and the right individual contact portion 23 are electrically connected to each other through the movable contact 30, and a switching circuit of the right individual contact portion 23 is turned on, whereby it is detected that the disc tray has been opened.

Subsequently, when the external force acting on the lever 40 is released, the lever 40 returns to a stationary position with a restoring force of the movable contact 30. Namely, since the spring portions 32 and 33 of the movable contact 30 rise due to their own elastic force, and a force that presses up the lever 40 acts from the base portion 31 to the whole bottom surface of the cam portion 42, the lever 40 rotates with the shaft portion 43 being as the support point to rise to an original position. As a result of this, the first contact portion 34 of the tip of the one spring portion slides and moves to a left side, and the first contact portion 34 separates from the right individual contact portion 23, and gets contact with the central common contact portion 21. Hence, the common contact portion 21 and the right individual contact portion 23 that have been electrically connected to each other until then are disconnected, and the switching circuit of the right individual contact portion 23 is turned off.

It is to be noted that when the disc tray of the BD player is closed, and a force in the arrow R direction is applied to the lever 40, the operating portion 41 tilts in an arrow Y direction, the common contact portion 21 and the left individual contact portion 22 are electrically connected to each other through the movable contact 30 due to operation opposite to the one in the previous description, and a switching circuit of the left individual contact portion 22 is turned on, whereby it is detected that the disc tray has been closed.

As described above, according to the switching device 1A of the embodiment, the connector 4 for coupling the flexible board 100 is integrated into the lever switch 2. Hence, if this switching device 1A is implemented on the circuit board 200 inside the electronic device, wiring with the lever switch 2 can be achieved by simple work of inserting the flexible board 100 in the connector 4. Hence, since the number of work processes can be reduced compared with the conventionally performed parts assembling work, and the work efficiency is also improved significantly, manufacturing cost of the whole electronic device can be reduced.

Embodiment of the Second Present Invention

Figure 9:
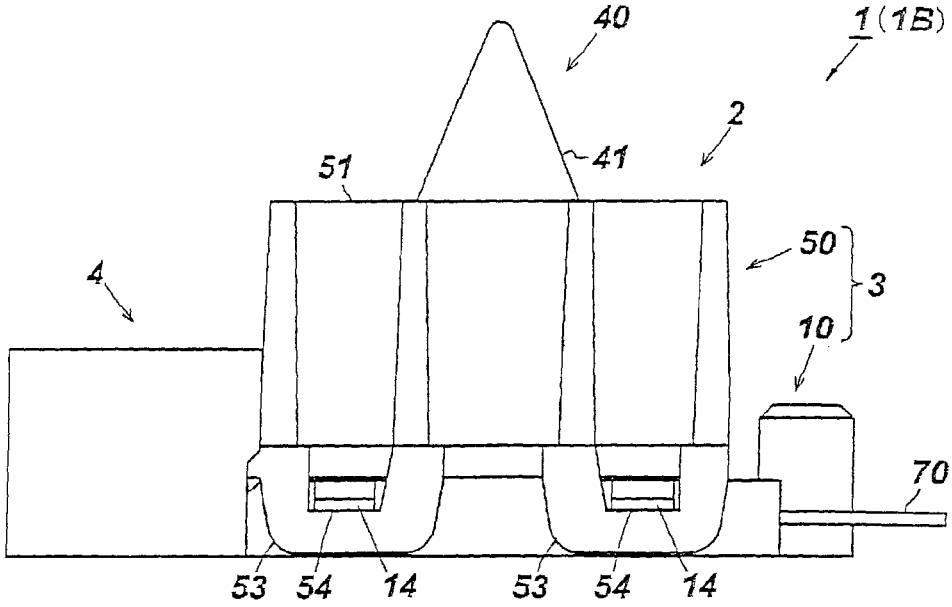
FIGS. 9A and 9B are views showing an embodiment of a switching device to which the second present invention is applied.
Figure 9:
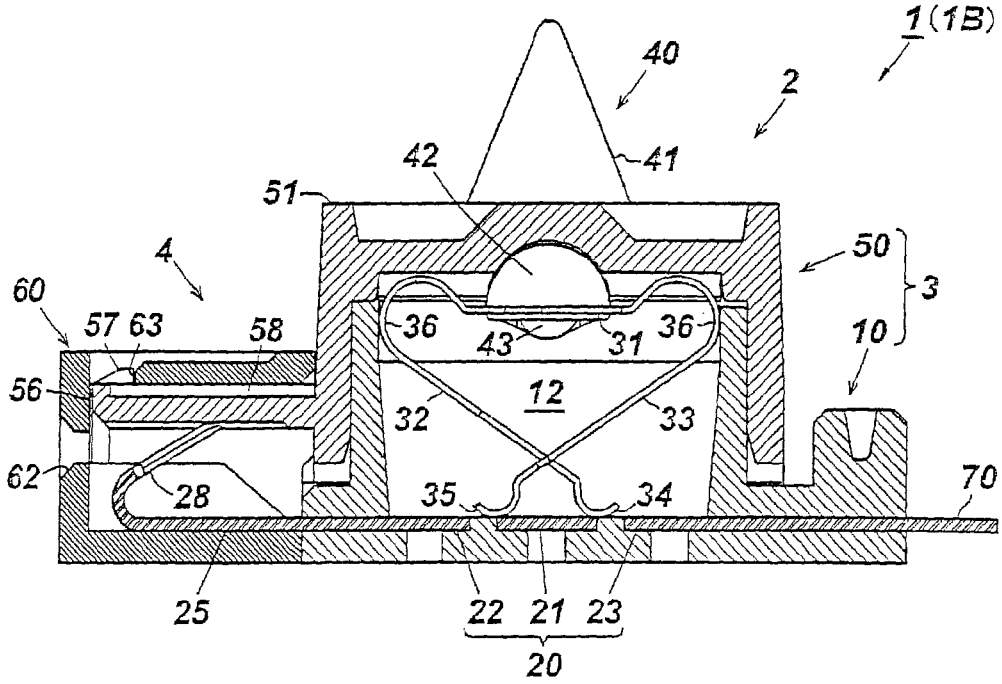
Figure 10:
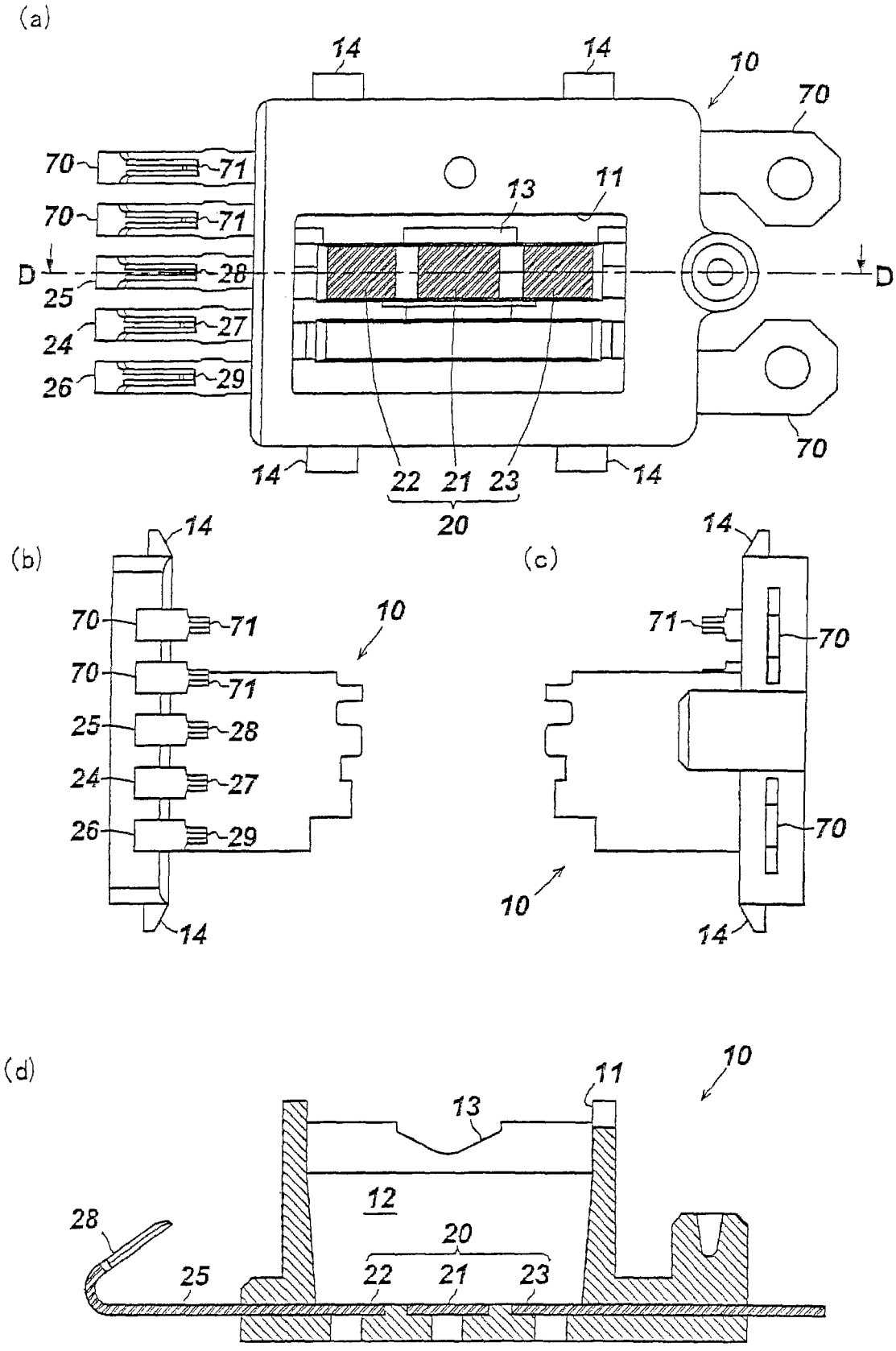
FIGS. 10A to 10D are explanatory views of a base and a fixed contact of FIGS. 9A and 9B.

FIGS. 9A and 9B are overall views showing a second embodiment of a switching device to which the second present invention is applied, and FIGS. 10A to 10D are parts views that constitute the same switching device.

A switching device 1 (1B) shown in FIGS. 9A and 9B is characterized in that a terminal for electronic part 70, the part being such as a motor that makes the disc tray operate, is further also provided in addition to a configuration in which the connector 4 for coupling the flexible board inside the device is integrated into the switch housed in the case 3. It is to be noted that description of the same components as the switching device 1A of the embodiment of the first present invention will be omitted by attaching the same symbols.

In the embodiment, the fixed contact 20 and the terminal for electronic part 70 are installed on the base 10 in the above-described process 1 of (1). As shown in FIGS. 10A to 10D, the terminal for electronic part 70 is formed by punching a metal plate with conductivity in a predetermined pattern, and it is provided as a terminal for a motor in the embodiment. This terminal for electronic part 70 is inserted on the bottom surface in the housing 12 at the time of forming the base 10, and two terminals for part 70 are provided respectively protruding from both side surfaces of the base 10. In addition, at the terminals for part 70 and 70 protruding from the left side surface of the base 10, provided are spring-like contact portions 71 and 71 whose tips are curved upwardly into U shapes.

Subsequently, when the one end of the flexible board 100 is inserted in the insertion opening 62 of the connector cover 60, the five U-shaped spring-like contact portions 71, 71, 27, 28, and 29 located inside the connector 4 bend and deform, the end of the flexible board 100 gets contact with the end surface of the case 3, and coupling between the connector 4 and the flexible board 100 is completed. As a result of this, the terminal 101 (refer to FIG. 8) of the flexible board 100 is connected to the terminals 70 and 70 for part, and to the connecting terminals 24, 25, and 26 of the fixed contact 20.

As described above, according to the switching device 1B of the embodiment to which the second present invention is applied, the connector 4 for coupling the flexible board 100 is integrated into the lever switch 2, and further, the terminal for electronic part 70 that connect the part, such as the motor, is also provided. Hence, if this switching device 1B is implemented on the circuit board 200 inside the electronic device, by simple work of inserting the flexible board 100 in the connector 4, can be achieved wiring between the terminal 101 (refer to FIG. 8) of the flexible board 100 and the lever switch 2, and wiring between the terminal 101 of the same flexible board 100 and the terminal for electronic part 70.

It is to be noted that although the terminal for electronic part 70 of this switching device 1B is utilized as the motor terminal in the embodiment, it can also be utilized as the terminal for connecting an other part instead of utilizing for the motor.

Embodiment of the Third Present Invention

Figure 11:
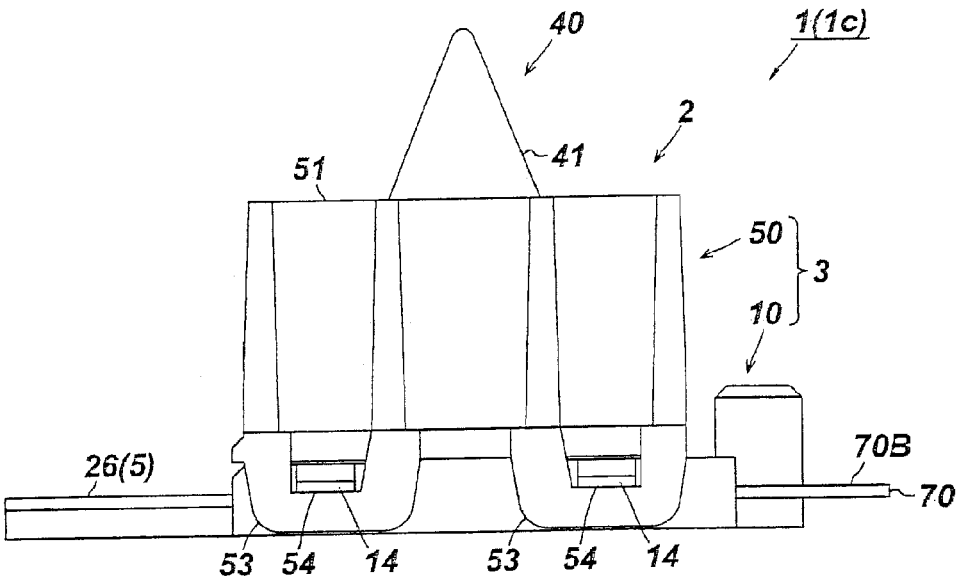
FIGS. 11A and 11B are views showing an embodiment of a switching device to which the third present invention is applied.
Figure 11:
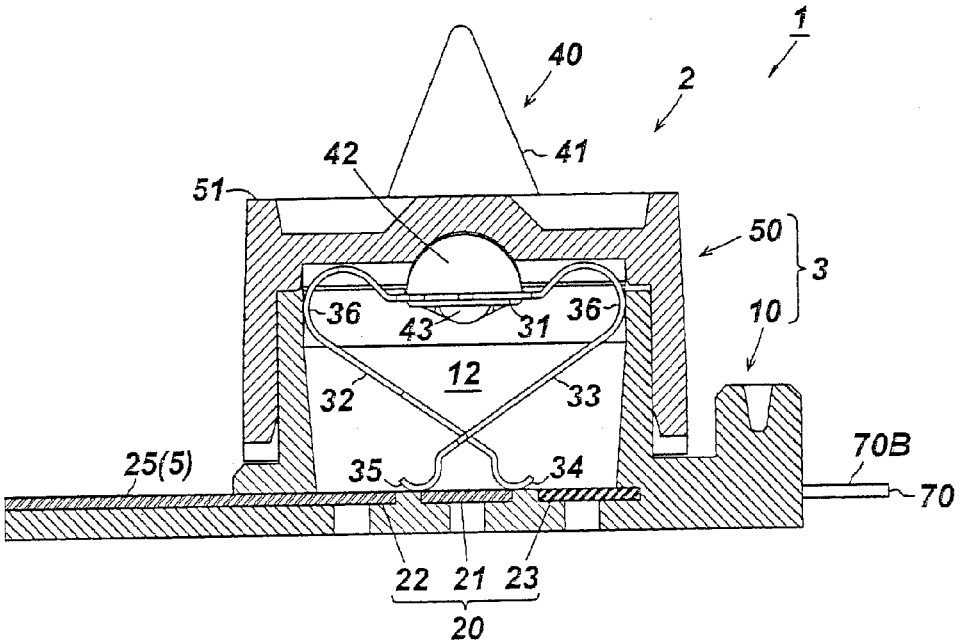
Figure 12:
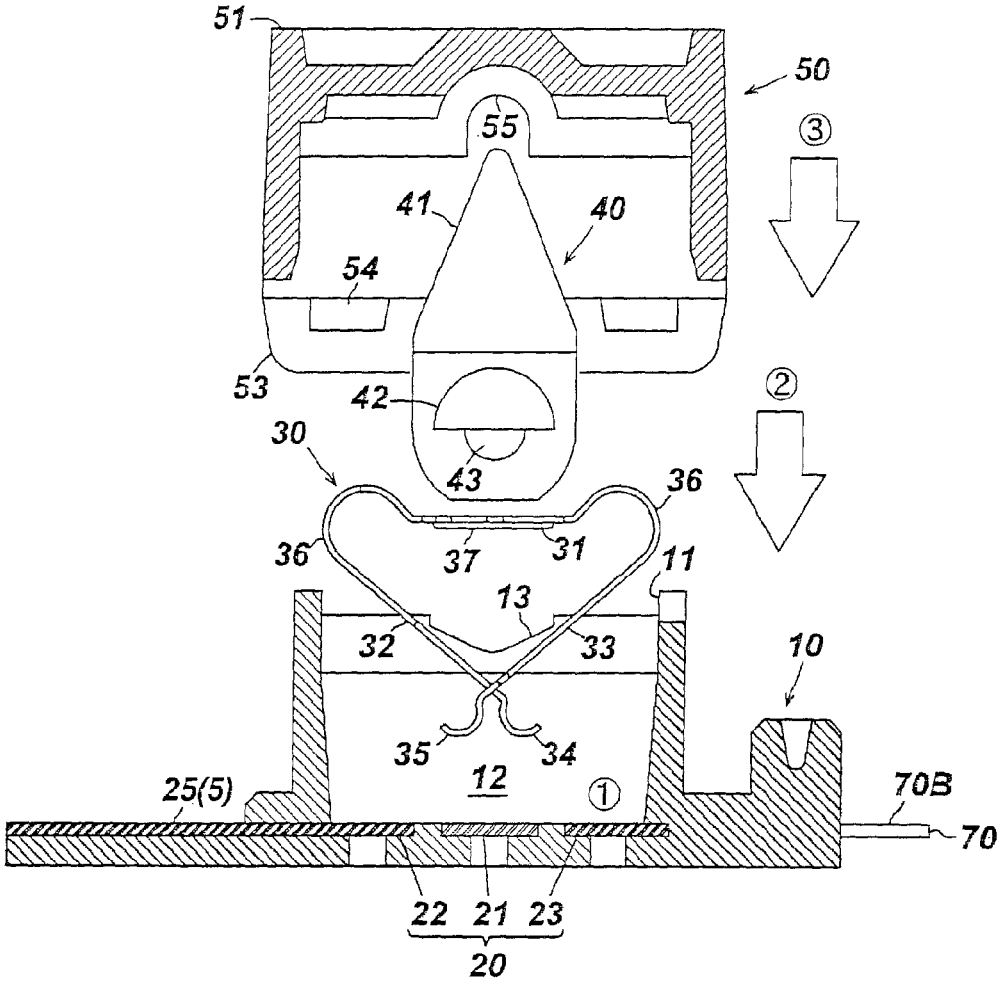
FIG. 12 is an assembly explanatory view of the switching device of FIGS. 11A and 11B.
Figure 12:
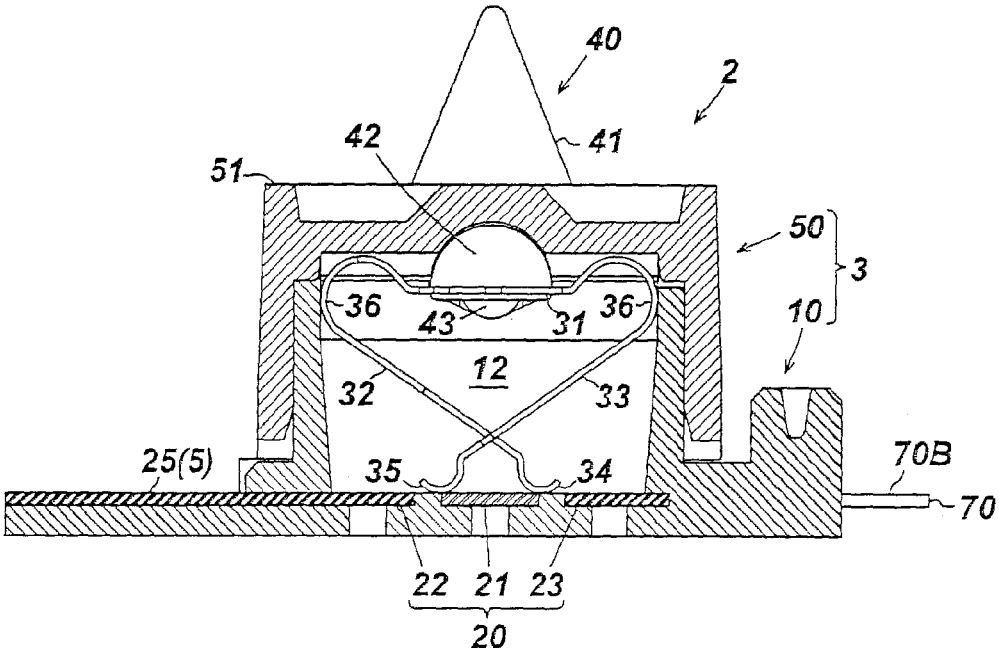
Figure 13:
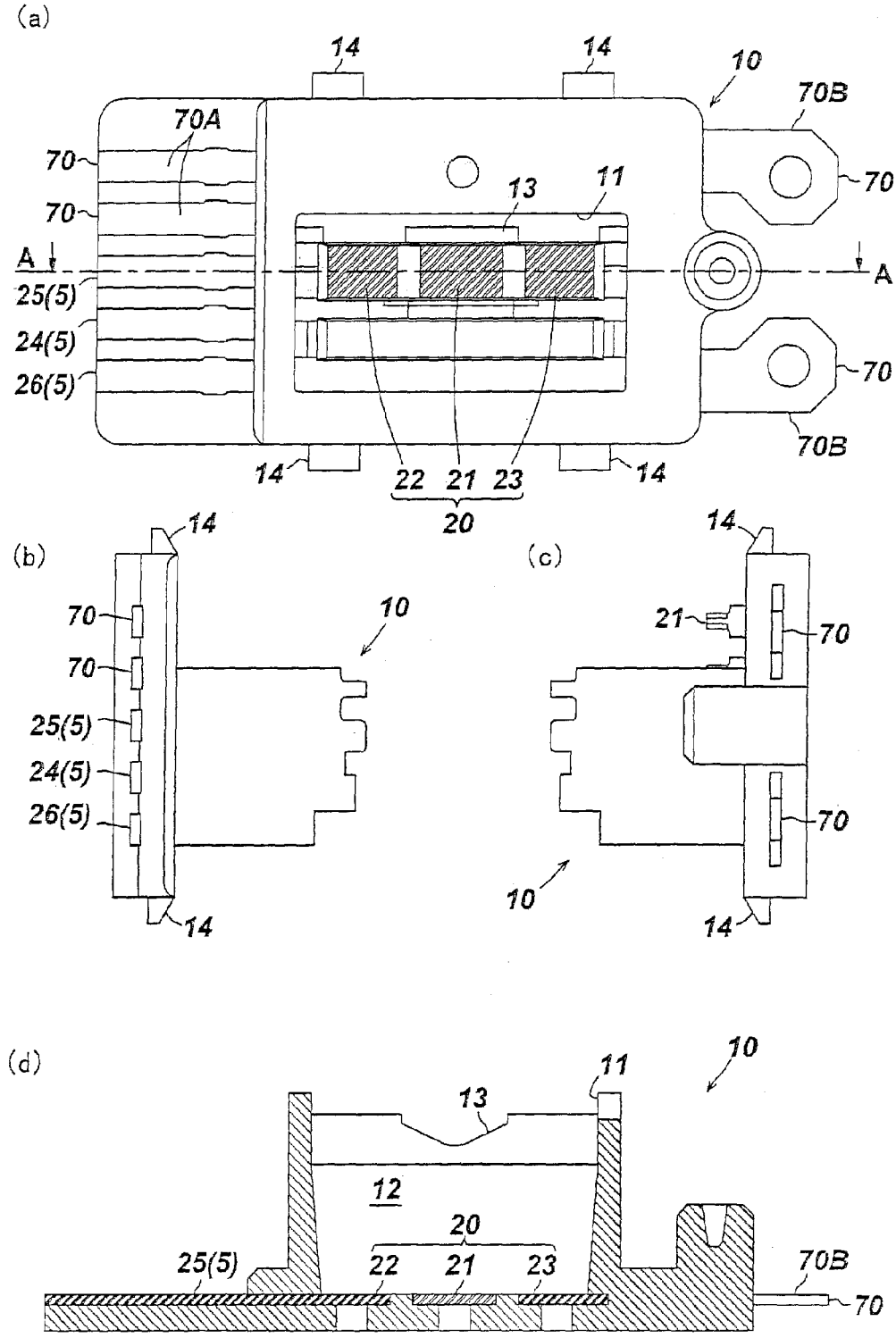
FIGS. 13A to 13D are explanatory views of a base and a fixed contact of FIGS. 11A and 11B.
Figure 14:
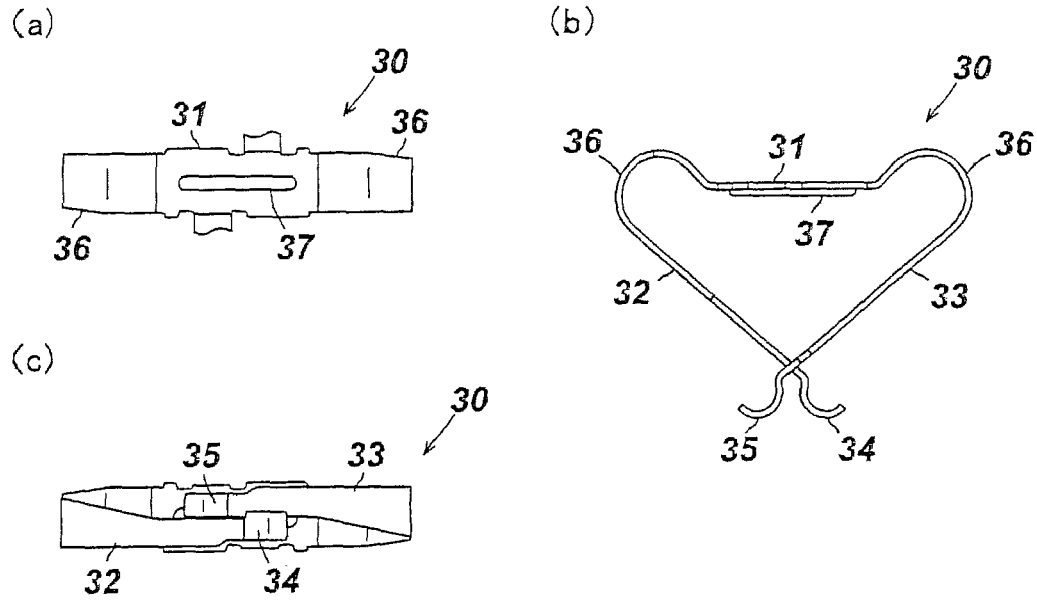
FIGS. 14A to 14C are explanatory views of a contact spring piece of FIGS. 11A and 11B.
Figure 15:
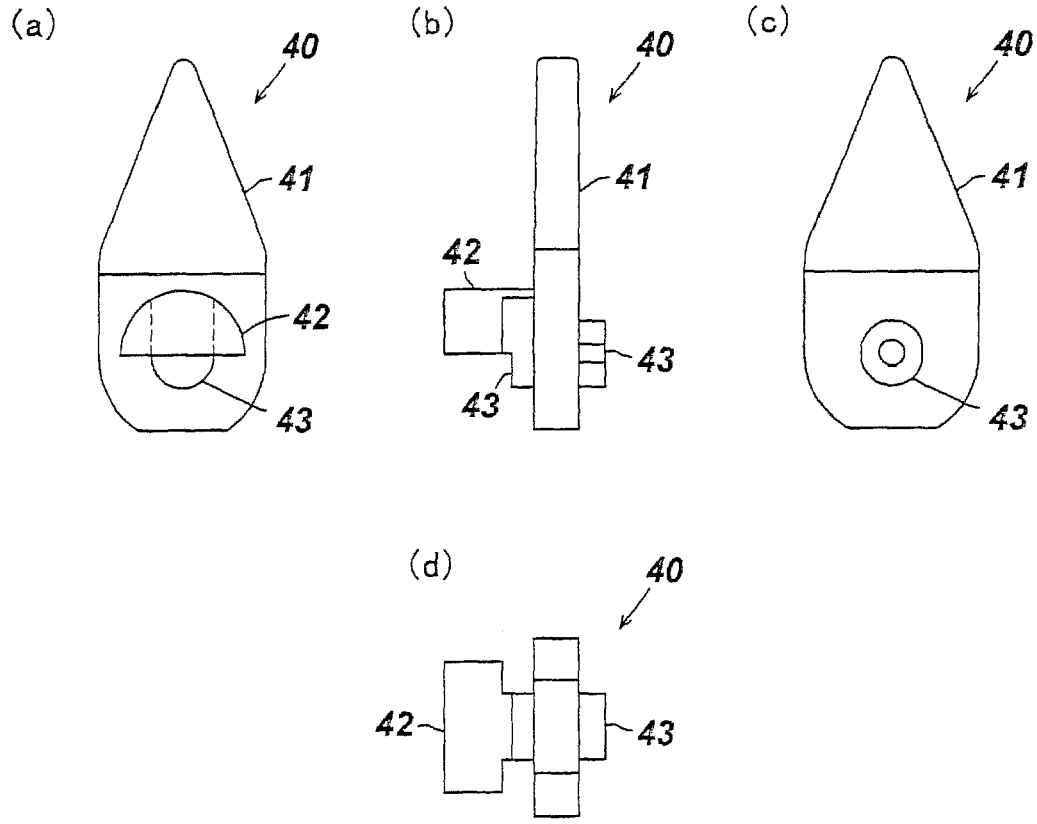
FIGS. 15A to 15D are explanatory views of a lever of FIGS. 11A and 11B.
Figure 16:
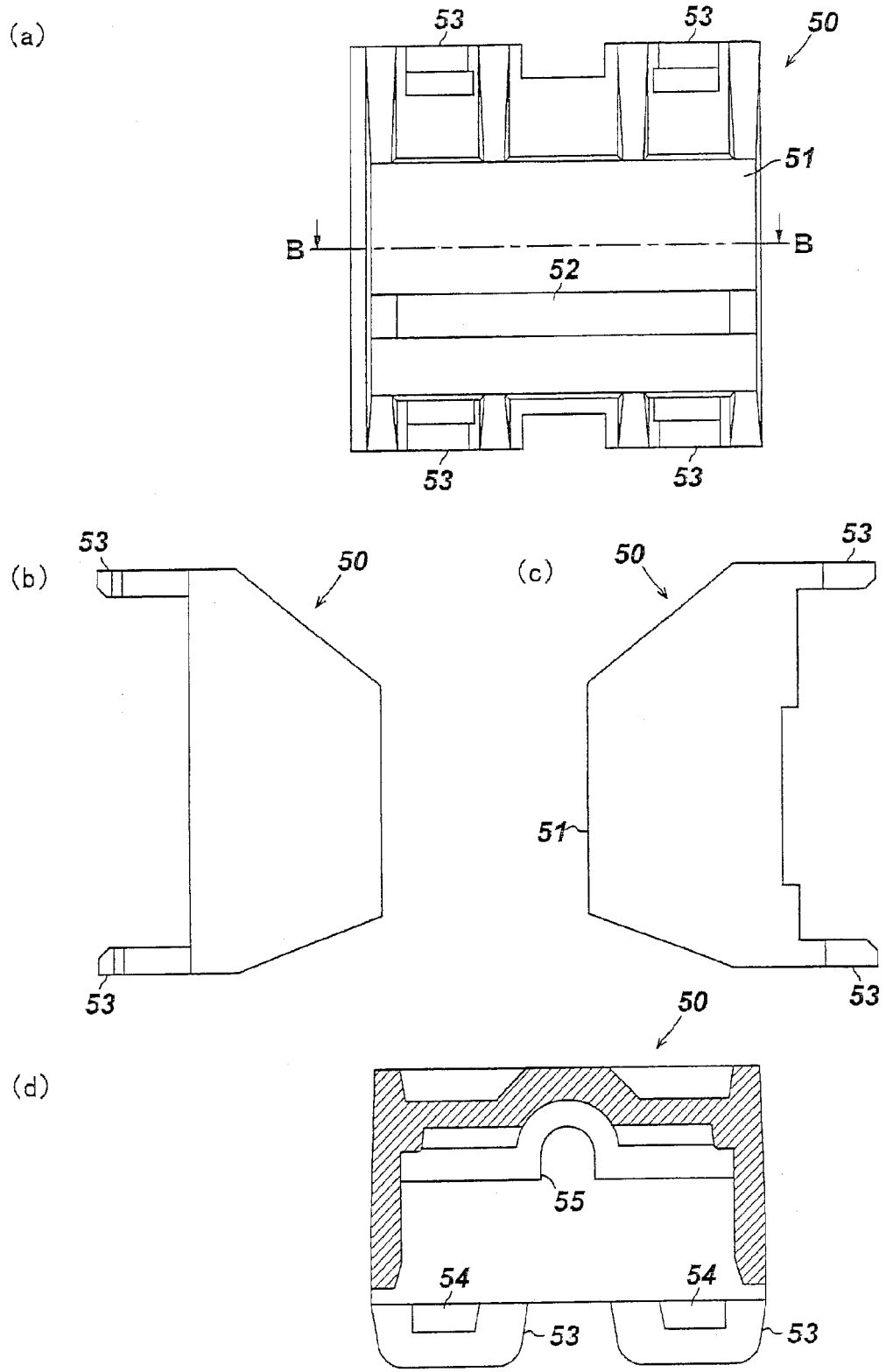
FIGS. 16A to 16D are explanatory views of a top case of FIGS. 11A and 11B.
Figure 17:
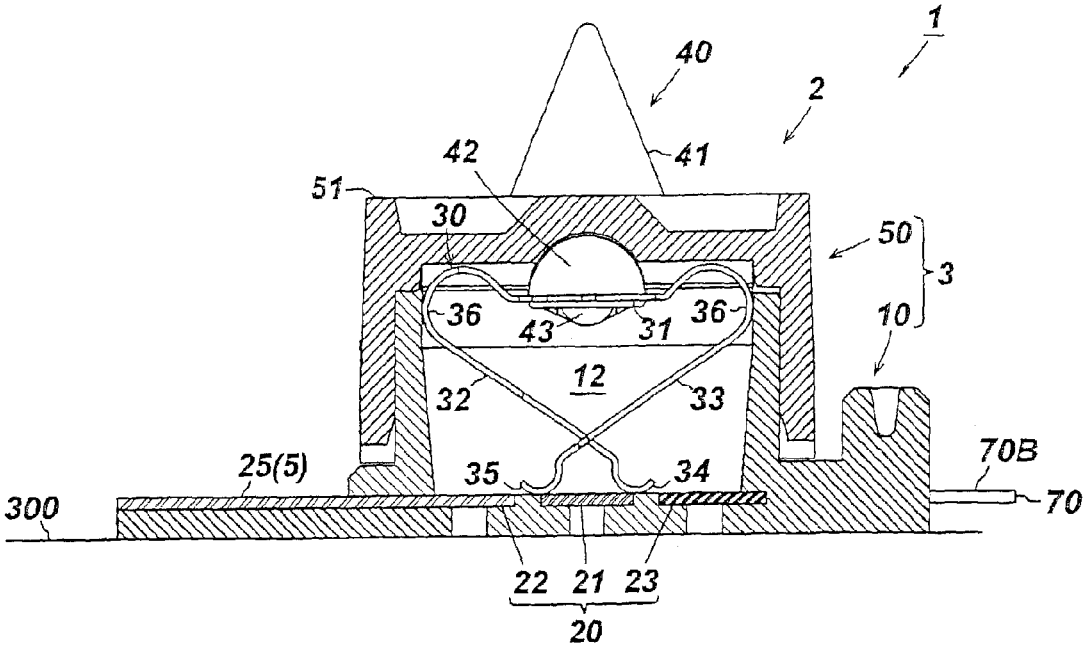
FIG. 17 is a usage explanatory view of the switching device of FIGS. 11A and 11B.
Figure 17:
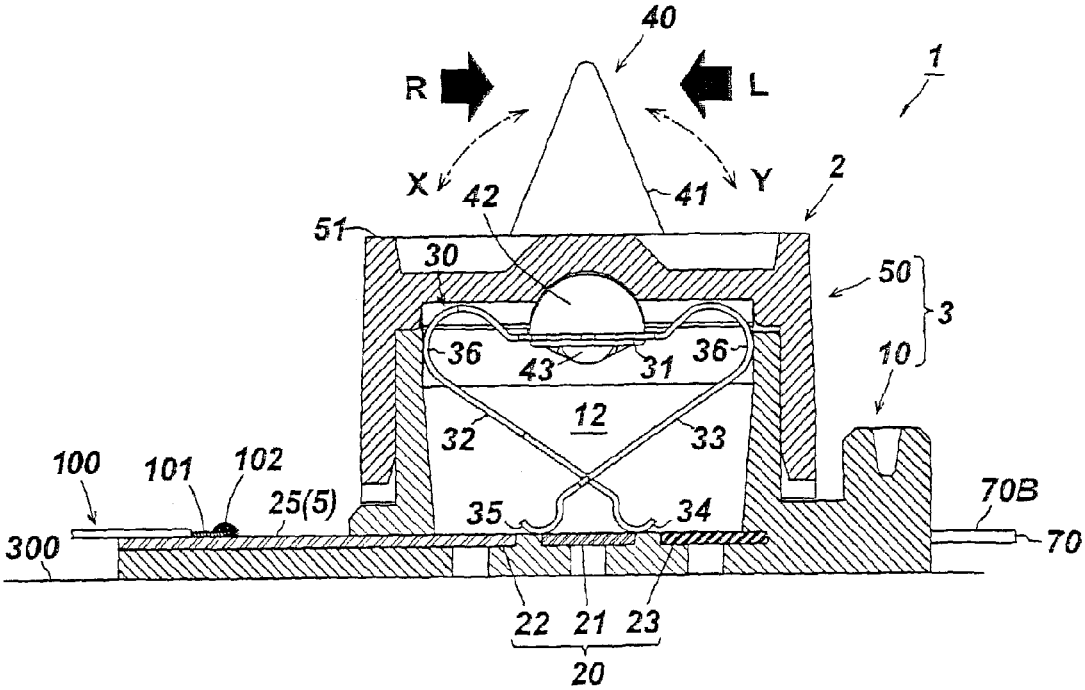

FIGS. 11A and 11B are overall views showing an embodiment of a switching device to which the third present invention is applied, FIG. 12 is an assembly explanatory view of the same switching device, FIGS. 13 to 16 are parts views that constitute the same switching device, and FIG. 17 is a usage explanatory view of the same switching device.

A switching device 1 (1C) shown in FIGS. 11A and 11B is used for detecting opening and closing of a disc tray located inside a device in a disc player, such as a CD, a DVD, or a BD, and it includes the lever switch 2 that is subjected to external forces from opposite two directions to thereby equally operate in the respective directions. In addition, at the switching device 1C, a coupling terminal portion 5 is provided as the portion for coupling a terminal of a flexible printed wiring board (hereinafter abbreviated as the "flexible board" in description of the embodiment) inside the device to a switch housed in the case 3, and further a terminal for a part (hereinafter referred to as the "terminal for electronic part 70 for external input"), such as a motor that drives the disc tray is also provided.

As shown in FIG. 12, this switching device 1C comprises each part of the base 10, the fixed contact 20, the movable contact 30, the coupling terminal portion 5 for the flexible board, the terminal for electronic part 70 for external input, the lever 40, and the top case 50, and the parts are assembled in accordance with next processes 1 to 4. Hereinafter, a detailed structure of the each part will be described in the process order.

(1) Process 1: Install on the base 10 the fixed contact 20, the coupling terminal portion 5 for the flexible board, and the terminal for electronic part 70 for external input.

In FIGS. 13A to 13D, the base 10 is formed of the resin material with the insulating property, and has the box having the opening 11 provided in the top surface thereof, and the housing 12 to house parts is provided inside the base 10. On the front surface and the back surface of the base 10, the pair of concave portions 13 and 13 for supporting the lever 40 are formed, and the hooks 14, 14, and . . . for applying the top case 50 are provided.

The fixed contact 20 is formed by punching the metal plate with conductivity in the predetermined pattern, and it is comprised of the central common contact portion 21 and the two individual contact portions 22 and 23 spaced apart at the both sides thereof. These common contact portion 21 and individual contact portions 22 and 23 are inserted on the bottom surface in the housing 12 at the time of forming the base 10, and the terminals connected to the above-described contacts, i.e., the connecting terminals 24, 25, and 26 of the fixed contact 20, are provided respectively protruding from the left side surface of a lower part of the case 3.

The coupling terminal portion 5 for the flexible board is comprised of the connecting terminals 24, 25, and 26 of the fixed contact 20 protruding from the case 50 as described above, and the terminal 101 (refer to FIG. 17) of the flexible board 100 is connected to the coupling terminal portion 5 for the flexible board.

The terminal for electronic part 70 for external input is formed by punching a metal plate with conductivity in a predetermined pattern, and it is provided as a motor terminal in the embodiment. This terminal for electronic part 70 for external input is inserted on the bottom surface in the housing 12 at the time of forming the base 10, and two terminals 70 for part for external input are provided respectively protruding from both side surfaces of the lower part of the case 3.

As shown in FIGS. 13A to 13D, on the left side surface of the base 10, starting from a back, one ends 70A and 70A of the terminals 70 and 70 for part for external input, the coupling terminal portion 5 comprised of the connecting terminal 25 of the left individual contact portion 22, the coupling terminal portion 5 comprised of the connecting terminal 24 of the common contact portion 21, and the coupling terminal portion 5 comprised of the connecting terminal 26 of the right individual contact portion 23 are arranged side by side at regular intervals.

(2) Process 2: Set the movable contact 30 and the lever 40 to the base 10.

As shown in FIGS. 14A to 14C, the movable contact 30 is comprised of a contact spring piece formed by bending a metal flat spring material into a predetermined shape. When this contact spring piece is viewed from the front, it is a shape of an inverted triangle, and the contact spring piece includes the pair of spring portions 32 and 33, which are formed by directing a base of the inverted triangle upwardly to be horizontal as the base portion 31, and by crossing the remaining two sides of the inverted triangle at the lower side.

The pair of spring portions 32 and 33 is set to have the same length, the first contact portion 34 is provided at the tip of one spring portion 32, and the second contact portion 35 is provided at the tip of the other spring portion 33. These first contact portion 34 and second contact portion 35 are respectively processed into semicircular shapes in order to make them slide easily on the fixed contact 20. It is to be noted that a proper elastic force is given to the movable contact 30 by half-bent portions 36 formed by curving the both ends of the base portion 31 into U shapes, and that durability is improved by the reinforcing rib 37 formed by making the center of the base portion 31 bulge downwardly.

As for setting work of the movable contact 30, as shown in FIG. 12, it is only necessary to insert the movable contact 30 from the opening 11 of the base 10, and then to place it on the bottom surface in the housing 12. As a result of this, the movable contact 30 rises due to the pair of spring portions 32 and 33, and both the first contact portion 34 and the second contact portion 35 get contact with the common contact portion 21 arranged in the center.

As shown in FIGS. 15A to 15D, the lever 40 is formed of the resin material with the insulating property, and it is comprised of the operating portion 41, the cam portion 42, and the shaft portion 43. The operating portion 41 is formed to be the thin plate, and the cam portion 42 cut out to be the semicircular shape is provided on the surface of the operating portion 41, and the pair of shaft portions 43 and 43 are protrudingly provided on both front and back surfaces of the operating portion 41.

The lever 40 is also set to the base 10, and the setting work is performed as shown in FIG. 12 such that the lever 40 is inserted from the opening 11 of the base 10, and the shaft portion 43 is inserted in the concave portion 13 of the base 10 to thereby support the both ends of the shaft portion 43 at the center of the concave portion 13. As a result of this, the lever 40 is rotatably supported on the bearing with the shaft portion 43 being as the support point. In addition, the bottom surface of the cam portion 42 is placed on the base portion 31 of the movable contact 30, and thereby the lever 40 is always in the state of being biased upwardly by the elastic force of the spring portions 32 and 33.

(3) Process 3: Apply the top case 50 to the base 10.

In FIGS. 16A to 16D, the top case 50 is formed of the resin material with the insulating property, and it has the top plate 51 that covers the opening 11 of the base 10. On the top plate 51, formed is the elongated slit 52 penetrating from the front surface to the back surface in order to make the operating portion 41 of the lever 40 protrude outside. In addition, at the top case 50, provided is the attaching piece 53 for applying the top case 50 to the base 10, and at this attaching piece 53, formed are the attaching holes 54, 54, and . . . that lock the hooks 14, 14, and . . . of the base 10. Further, on the inner side of the attaching piece 53, formed is the concave portion 55 that prevents interference with the shaft portion 43 of the lever 40.

In order to apply the top case 50 to the base 10, as shown in FIG. 12, the top case 50 is covered on the base 10, and the hooks 14, 14, and . . . are hooked and locked to the four attaching holes 54, 54, and . . . in all. As a result of this, the case 3, which is the integration between the base 10 and the top case 50, is formed, and it serves as the lever switch 2 in which the movable contact 30 and the lever 40 have been housed in the housing 12 thereinside.

When the top case 50 is applied, only the operating portion 41 of the lever 40 protrudes outside the case 3 from the slit 52, and the lever 40 is retained as it is by the shaft portion 43 interposed between the concave portion 55 of the top case 50 and the concave portion 13 of the base 10. In addition, the back surface of the top plate 51 of the top case 50 presses the half-bent portions 36 and 36 of the both sides of the contact spring piece, and thereby uplift of the movable contact 30 is restricted at the time of operation of the lever 40.

The switching device 1C of the third embodiment to which the present invention is applied is configured as described above, and a manner of use of the switching device 1C will be described hereinafter.

As shown in FIG. 17, when this switching device 1C is used, the case 3 of the switching device 1C is fixed to a disc loading device 300, such as a BD player. In addition, a lead of a motor, such as a loading motor, is connected to the other end 70B of the terminal 70 for part for external input, and the corresponding terminal 101 of the flexible board 100 is connected to each of one end 70A of the same terminal for electronic part 70 and the coupling terminal portion 5 using a conductive agent 102, such as solder. It is to be noted that a connector may be used to connect the above-described parts to each other instead of using the conductive agent 102 although an illustration of the connector is omitted.

In the lever switch 2 constituting the switching device 1C, when the external force acts in the direction shown with the arrow L or R with respect to the operating portion 41 of the lever 40 protruding from the case 3, the lever 40 tilts in the each direction with the shaft portion 43 being as the support point to switch contact between the movable contact 30 and the fixed contact 20.

Namely, when the disc tray of the BD player is opened, and the force in the arrow L direction is applied to the lever 40, the operating portion 41 tilts in the arrow X direction, and the corner of the cam portion 42 that has tilted in tandem with this tilt of the operating portion 41 presses the left end of the base portion 31 of the movable contact 30. The movable contact 30 is elastically deformed by this pressing force, and the first contact portion 34 of the tip of the one spring portion slides and moves to the right side, whereby the first contact portion 34 separates from the central common contact portion 21, and gets contact with the right individual contact portion 23. At this time, the second contact portion 35 of the tip of the other spring portion remains in contact with the common contact portion 21. Hence, the common contact portion 21 and the right individual contact portion 23 are electrically connected to each other through the movable contact 30, and the switching circuit of the right individual contact portion 23 is turned on, whereby it is detected that the disc tray has been opened.

Subsequently, when the external force acting on the lever 40 is released, the lever 40 returns to the stationary position with the restoring force of the movable contact 30. Namely, since the spring portions 32 and 33 of the movable contact 30 rise due to their own elastic force, and the force that presses up the lever 40 acts from the base portion 31 to the whole bottom surface of the cam portion 42, the lever 40 rotates with the shaft portion 43 being as the support point to rise to the original position. As a result of this, the first contact portion 34 of the tip of the one spring portion slides and moves to the left side, and the first contact portion 34 separates from the right individual contact portion 23, and gets contact with the central common contact portion 21. Hence, the common contact portion 21 and the right individual contact portion 23 that have been electrically connected to each other until then are disconnected, and the switching circuit of the right individual contact portion 23 is turned off.

It is to be noted that when the disc tray of the BD player is closed, and the force in the arrow R direction is applied to the lever 40, the operating portion 41 tilts in the arrow Y direction, the common contact portion 21 and the left individual contact portion 22 are electrically connected to each other through the movable contact 30 due to operation opposite to the one in the previous description, and the switching circuit of the left individual contact portion 22 is turned on, whereby it is detected that the disc tray has been closed.

As described above, in the switching device 1C of the embodiment to which the third present invention is applied, the coupling terminal portion 5 for the flexible board is provided at the lever switch 2, and further, the terminal for electronic part 70 for external input is also provided. Hence, for example, by simple work only of mounting this switching device 1C on the disc loading device 300, and of connecting the corresponding terminal of the flexible board 100 to each of the coupling terminal portion 5 in the mounted switching device 1C and the one end 70A of the terminal 70 for part for external input, can be achieved wiring between the lever switch 2 and the flexible board 100, and wiring between a component part (motor in the embodiment) of the disc loading device 300 and the flexible board 100. Hence, since the number of work processes can be reduced compared with the conventionally performed parts assembling work, and the work efficiency is also improved significantly, manufacturing cost of the whole electronic device can be reduced.

It is to be noted that although the terminal 70 for part for external input is utilized as the motor terminal in the above-described embodiment, it can also be utilized as the terminal for connecting an other part instead of utilizing for the motor.

In the above-described switching device 1C of the embodiment to which the third present invention is applied, although a configuration is employed in which the coupling terminal portion 5 for the flexible board and the terminal 70 for part for external input are provided at the lever switch 2, the terminal 70 for part for external input can be arbitrarily omitted if needed.

In addition, the first to the third present inventions are not limited to the above-described embodiments, and a number of modifications can be performed by those who have usual knowledge in the art within technical ideas of the respective present inventions.

REFERENCE SIGNS LIST

1 SWITCHING DEVICE
2 LEVER SWITCH
3 CASE
4 CONNECTOR
5 CONNECTING TERMINAL PORTION
10 BASE
11 OPENING
12 HOUSING
13 CONCAVE PORTION

14 HOOK
20 FIXED CONTACT
21 COMMON CONTACT PORTION
22 INDIVIDUAL CONTACT PORTION
23 INDIVIDUAL CONTACT PORTION
24 CONNECTING TERMINAL
25 CONNECTING TERMINAL
26 CONNECTING TERMINAL
27 SPRING-LIKE CONTACT PORTION
28 SPRING-LIKE CONTACT PORTION
29 SPRING-LIKE CONTACT PORTION
30 MOVABLE CONTACT
31 BASE PORTION
32 SPRING PORTION
33 SPRING PORTION
34 FIRST CONTACT PORTION
35 SECOND CONTACT PORTION
36 HALF-BENT PORTION
37 REINFORCING RIB
40 LEVER
41 OPERATING PORTION
42 CAM PORTION
43 SHAFT PORTION
50 TOP CASE
51 TOP PLATE
52 SLIT
53 ATTACHING PIECE
54 ATTACHING HOLE
55 CONCAVE PORTION
56 FLANGE
57 LOCKING CLAW
58 HOLLOW PORTION
60 CONNECTOR COVER
61 COVER MAIN BODY
62 INSERTION OPENING
63 LOCKING HOLE
70 TERMINAL FOR ELECTRONIC PART
70A ONE END OF TERMINAL FOR ELECTRONIC PART
70B OTHER END OF TERMINAL FOR ELECTRONIC PART
71 SPRING-LIKE CONTACT PORTION
100 FLEXIBLE BOARD
101 TERMINAL OF FLEXIBLE BOARD
102 CONDUCTIVE AGENT
200 CIRCUIT BOARD
300 DISC LOADING DEVICE

What is claimed is:

1. A switching device formed by integrating a connector for a flexible printed wiring board into a lever switch, wherein
the lever switch comprises:
a fixed contact and a movable contact installed in a case; and
a lever that deforms the movable contact by tilt operation to switch contact with the fixed contact, the lever being supported by the case, and
the connector comprises
a connector cover which covers a connecting terminal of the fixed contact protruding from the case, and in which an insertion opening to insert the flexible printed wiring board is provided, and
a terminal of the flexible printed wiring board is connected to the connecting terminal of the fixed contact by inserting the flexible printed wiring board in the insertion opening.

2. The switching device according to claim 1, wherein
a coupling structure of the case and the connector cover is a structure in which a locking claw is provided at a tip of a flange extended on a side surface of the case, and in which the locking claw fits in a locking hole of the connector cover when the connector cover is applied to the flange.

3. The switching device according to claim 1, wherein
a spring-like contact portion whose tip is curved is provided at the terminal for electronic part protruding from the case or at the connecting terminal of the fixed contact.

4. The switching device according to claim 1, wherein
a coupling structure of the case and the connector cover is a structure in which a locking claw is provided at a tip of a flange extended on a side surface of the case, and in which the locking claw fits in a locking hole of the connector cover when the connector cover is applied to the flange, and
a spring-like contact portion whose tip is curved is provided at the terminal for electronic part protruding from the case or at the connecting terminal of the fixed contact.

5. An electronic device comprising the switching device according to claim 1.

6. A switching device formed by integrating a connector for a flexible printed wiring board into a lever switch, wherein
the lever switch comprises:
a terminal for electronic part, a fixed contact, and a movable contact that are installed in a case; and
a lever that deforms the movable contact by tilt operation to switch contact with the fixed contact, the lever being supported by the case, and
the connector comprises
a connector cover which covers one end of the terminal for electronic part protruding from the case and a connecting terminal of the fixed contact protruding from the case, and in which an insertion opening to insert the flexible printed wiring board is provided, and each of terminals of the flexible printed wiring board is connected to the terminal for electronic part and to the connecting terminal of the fixed contact by inserting the flexible printed wiring board in the insertion opening.

7. The switching device according to claim 6, wherein the terminal for electronic part is a terminal for a motor.

8. A switching device in which a coupling terminal portion for a flexible printed wiring board is provided at a lever switch, wherein
the lever switch comprises:
a fixed contact and a movable contact that are installed in a case; and
a lever that deforms the movable contact by tilt operation to switch contact with the fixed contact, the lever being supported by the case, and
the coupling terminal portion is comprised of
a connecting terminal of the fixed contact protruding from the case, and
a terminal of the flexible printed wiring board is connected to the coupling terminal portion.

9. The switching device according to claim 8, wherein
the lever switch has a terminal for electronic part for external input other than the fixed contact, and
one end of the terminal for electronic part for external input is arranged side by side with the coupling terminal portion, and
each of the terminals of the flexible printed wiring board is connected to the coupling terminal portion and the one end of the terminal for electronic part for external input.

10. An electronic device comprising the switching device according to claim 8.

* * * * *